US008337249B2

(12) United States Patent
Lappoehn

(10) Patent No.: US 8,337,249 B2
(45) Date of Patent: Dec. 25, 2012

(54) RIGHT-ANGLE CONNECTOR HAVING A SHIELDING AND METHOD FOR PRODUCING THE SHIELDING OF THE RIGHT-ANGLE CONNECTOR

(75) Inventor: Juergen Lappoehn, Gammelshausen (DE)

(73) Assignee: ERNI Electronics GmbH, Adelberg (DE)

( * ) Notice: Subject to any disclaimer, the term of this patent is extended or adjusted under 35 U.S.C. 154(b) by 0 days.

(21) Appl. No.: 12/998,600

(22) PCT Filed: Oct. 22, 2009

(86) PCT No.: PCT/DE2009/001483

§ 371 (c)(1),
(2), (4) Date: May 6, 2011

(87) PCT Pub. No.: WO2010/051791

PCT Pub. Date: May 14, 2010

(65) Prior Publication Data

US 2011/0217868 A1 Sep. 8, 2011

(30) Foreign Application Priority Data

Nov. 10, 2008 (DE) ..... 10 2008 056 586
Mar. 28, 2009 (DE) ..... 10 2009 015 462

(51) Int. Cl.
*H01R 13/648* (2006.01)

(52) U.S. Cl. ..... 439/607.55; 439/607.4

(58) Field of Classification Search . 439/607.05–607.11, 607.13, 607.35–607.4, 439/607.32–607.34, 607.55
See application file for complete search history.

(56) References Cited

U.S. PATENT DOCUMENTS 5,207,597 A 5/1993 Kline et al.
(Continued)

FOREIGN PATENT DOCUMENTS

DE 692 21 560 1/1998
(Continued)

OTHER PUBLICATIONS

Catalogue E 074482, www.erni.com, Aug. 2006, Edition 4, 2006, p. 81. (Spec, p. 2).

(Continued)

*Primary Examiner* — Ross Gushi
(74) *Attorney, Agent, or Firm* — Collard & Roe, P.C.

(57) ABSTRACT

The invention relates to a right-angle connector (20*a*, 20*b*), comprising a plurality of contact elements (50*a*, 50*b*) which are arranged next to one another and provided at the back of the right-angle connector (20*a*, 20*b*) for soldering to conductors of a printed circuit board (4), comprising an upper shielding (22*a*, 22*b*) arranged at least on the upper side of the right-angle connector (20*a*, 20*b*) and a lower shielding (34*a*, 34*b*) arranged on the lower side. The right-angle (20*a*, 20*b*) according to the invention is characterized in that the lower shielding (34*a*, 34*b*) contains a lower shielding element (36*a*, 36*b*) on the connector side, the shielding surface (37*a*, 37*b*) of the element being oriented in the connecting direction (28), the lower shielding (34*a*, 34*b*) furthermore contains a separate, rear lower shielding element (38*a*, 38*b*), and the lower shielding elements (36*a*, 36*b*, 38*a*, 38*b*) are electrically connected to each other. The method according to the invention for producing the right-angle connector (20*a*, 20*b*) uses a laser weld connection for at least the two lower shielding elements (36*a*, 36*b*, 38*a*, 38*b*). The right-angle connector (20*a*, 20*b*) according to the invention allows high-frequency signals to be conducted with high signal quality and high signal integrity. The shielding of the right-angle connector (20*a*, 20*b*) according to the invention can be produced in a cost-effective manner with the method according to the invention.

17 Claims, 13 Drawing Sheets

U.S. PATENT DOCUMENTS

Figure 1:
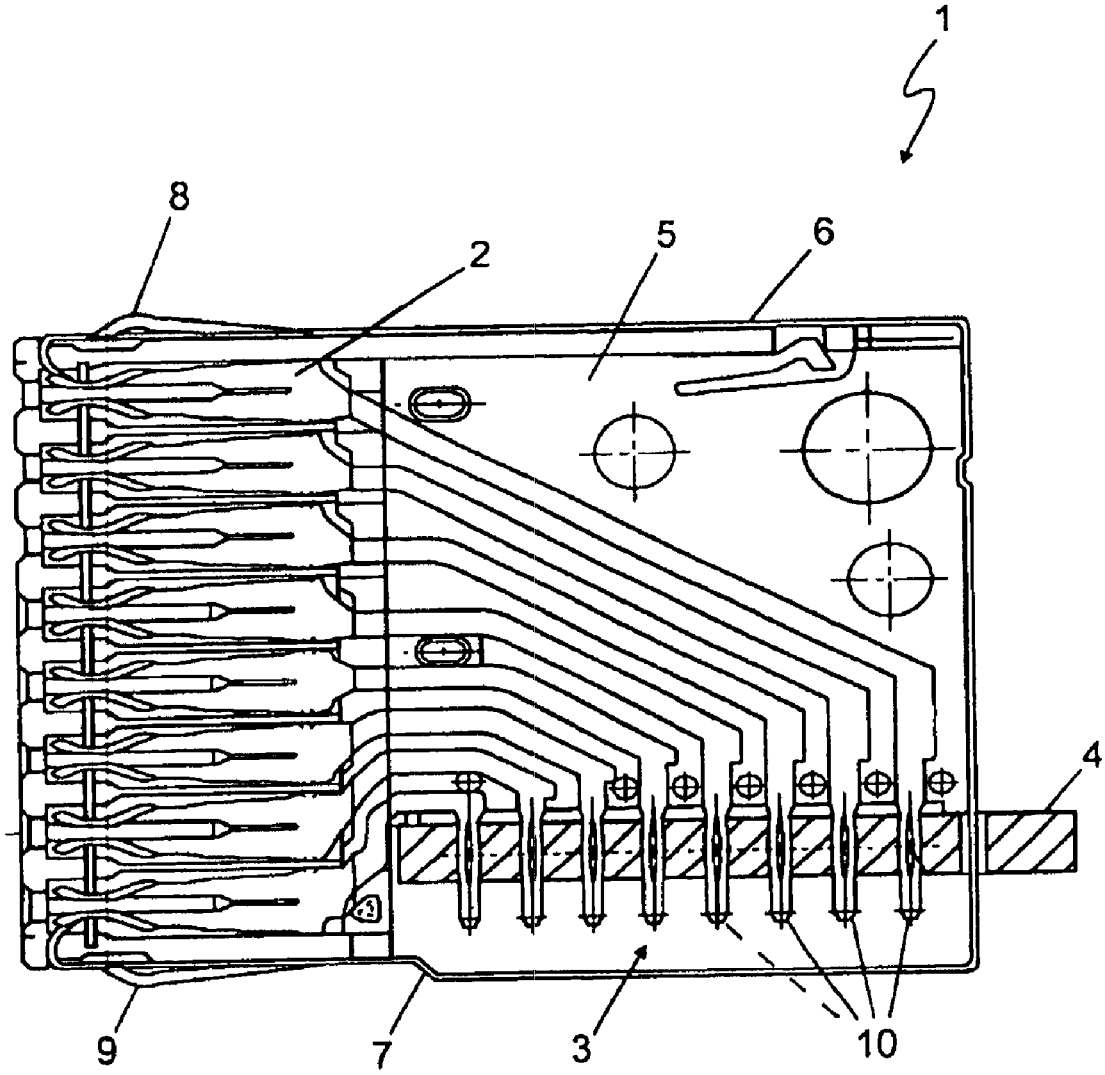
Fig.1 (Prior Art)

| | | | | |
|---|---|---|---|---|
| 6,827,610 | B2 * | 12/2004 | Lin | 439/607.37 |
| 6,875,031 | B1 * | 4/2005 | Korsunsky et al. | 439/79 |
| 6,893,272 | B2 * | 5/2005 | Yu | 439/79 |
| 6,981,898 | B2 | 1/2006 | Akama et al. | |
| 7,033,210 | B1 | 4/2006 | Laurer et al. | |
| 7,261,598 | B1 * | 8/2007 | Tseng | 439/607.36 |
| 7,297,025 | B2 * | 11/2007 | Wei | 439/607.04 |
| 7,297,027 | B2 * | 11/2007 | Liang | 439/607.07 |
| 7,300,312 | B1 * | 11/2007 | Chen et al. | 439/607.31 |
| 7,364,463 | B1 * | 4/2008 | Ju | 439/607.55 |
| 7,390,219 | B2 * | 6/2008 | Pan | 439/607.13 |
| 7,744,418 | B2 * | 6/2010 | He et al. | 439/607.35 |
| 7,748,999 | B1 * | 7/2010 | Sun et al. | 439/79 |
| 7,758,380 | B2 * | 7/2010 | Wang et al. | 439/607.23 |
| 7,762,840 | B2 * | 7/2010 | Hamner et al. | 439/541.5 |
| 7,922,533 | B2 * | 4/2011 | Wang et al. | 439/607.23 |
| 7,922,535 | B1 * | 4/2011 | Jiang et al. | 439/607.35 |
| 8,011,956 | B1 * | 9/2011 | Yang et al. | 439/589 |
| 8,109,791 | B2 * | 2/2012 | Kameyama et al. | 439/607.37 |
| 2001/0012730 | A1 * | 8/2001 | Ramey et al. | 439/608 |
| 2001/0036769 | A1 * | 11/2001 | Otto et al. | 439/607 |
| 2002/0123266 | A1 * | 9/2002 | Ramey et al. | 439/608 |
| 2004/0157491 | A1 * | 8/2004 | Lin | 439/607 |
| 2004/0224559 | A1 * | 11/2004 | Nelson et al. | 439/608 |
| 2005/0208831 | A1 * | 9/2005 | Lee | 439/608 |
| 2006/0292929 | A1 * | 12/2006 | Wei | 439/607 |
| 2007/0054552 | A1 * | 3/2007 | Liang | 439/607 |
| 2007/0197093 | A1 * | 8/2007 | Chen et al. | 439/607 |
| 2008/0014798 | A1 * | 1/2008 | Pan | 439/607 |
| 2008/0020642 | A1 * | 1/2008 | Pan | 439/607 |
| 2008/0096423 | A1 * | 4/2008 | Huang | 439/608 |
| 2008/0166918 | A1 * | 7/2008 | Yang et al. | 439/608 |
| 2009/0253297 | A1 * | 10/2009 | Kamata et al. | 439/607.35 |
| 2011/0086546 | A1 * | 4/2011 | Mao et al. | 439/607.4 |
| 2011/0092098 | A1 * | 4/2011 | Yang et al. | 439/607.37 |

FOREIGN PATENT DOCUMENTS

| | | |
|---|---|---|
| DE | 201 14 581 | 2/2002 |
| DE | 695 24 935 | 8/2002 |
| DE | 602 08 885 | 8/2006 |
| DE | 603 14 140 | 12/2007 |
| EP | 0 719 463 | 7/1996 |
| EP | 1 146 595 | 10/2001 |
| EP | 1 516 395 | 3/2005 |
| WO | WO 2004/091055 | 10/2004 |

OTHER PUBLICATIONS

Telecommunications Standard FCC 68 500, 47 CFR CH. I (Oct. 1, 1999 Edition), pp. 350-394. (Spec, p. 1).

International Standard IEC 61076-4-101, Second Edition, Sep. 2001, pp. 1-197 (odd pages in English only). (Spec, p. 2).

English translation of the International Preliminary Report on Patentability and Written Opinion of the International Searching Authority in PCT/DE2009/001483, May 19, 2011.

International Search Report.

* cited by examiner

RIGHT-ANGLE CONNECTOR HAVING A SHIELDING AND METHOD FOR PRODUCING THE SHIELDING OF THE RIGHT-ANGLE CONNECTOR

CROSS REFERENCE TO RELATED APPLICATIONS

This application is the National Stage of PCT/DE2009/001483 filed on Oct. 22, 2009, which claims priority under 35 U.S.C. §119 of German Application No. 10 2008 056 586.5 filed on Nov. 10, 2008 and German Application No. 10 2009 015 462.0 filed on Mar. 28, 2009, the disclosures of which are incorporated by reference. The international application under PCT article 21(2) was not published in English.

The invention relates to a right-angle connector having a shielding and a method for producing the shielding of the right-angle connector.

PRIOR ART

The utility model according to DE 201 14 581 U1 discloses a connector for a data cable according to US Telecommunications Standard FCC 68 500 which is designated as RJ 45 connector. In the central and rear region of the connectors, the contact elements are surrounded by a shielding which is open at the back which is made from a sheet metal part, for example, by bending. The shielding covering the side surfaces and the upper and lower side of the connector housing can be simply fabricated since the connector is implemented as a straight connector.

DE 692 21 560 T2 describes a connector which can form the corresponding connector to the connector described previously according to DE 201 14 581 U1. A shielding plate is provided which is bent around the connector housing in the upper region and in the rear region. No shielding is provided on the lower side of the contact elements.

DE 603 14 140 T2 describes an impedance-tuned connector which has a two-part shielding, where a first shielding element completely encloses the contact elements in the front region of the connector. The entire connector including the front shielding element is surrounded by an outer shielding plate which has embossings and recesses. In the rear region of the contact elements which is provided for soldering to conductors of a printed circuit board, the shielding element has recesses which allow the contact elements to be guided out from the shielding region.

DE 602 08 885 T2 describes a connector containing a shielding housing which encloses the side surfaces and the upper side. A shielding is also provided on the underside which in a first connector is disposed directly on the printed circuit board and in a corresponding connector is disposed on the underside of the plastic connector housing. On the rear side of the connector the shielding element has recesses through which the contact elements are guided from the shielding region.

On page 81 of the Catalogue E 074482 of the applicant Erni, August 2006, Edition 4, which can be viewed at www.erni.com, a right-angle connector in accordance with IEC 61076-4-101 is described in which shieldings are provided both on the upper side and on the underside, in which recesses are cut out in the front connector-side region both on the upper side and on the underside and the remaining bridges are curved out to form springs. The lower shielding encloses the underside of the end pieces of the contact elements provided for soldering to conductors of the printed circuit board so that the known connector can only be pushed laterally onto the printed circuit board because in the mounted state of the connector the lower shielding is positioned on the underside of the printed circuit board and completely covers the contact region there.

DE 695 24 935 T2 discloses a shielded connector arrangement which provides for welding of shielding elements to one another. A straight connector forms the basis. The welded connection is provided between the shielding elements which are freely accessible on the outer side of the connector so that a soldered, a glued or another type of fixing possibility are proposed alternatively to the welded connection. The connection can also be completely omitted and held simply in its position by the stability of the completely assembled connector arrangement.

It is the object of the invention to provide a right-angle connector having a shielding which is easy to manufacture and a method for manufacturing the shielding of the right-angle connector which make it possible to achieve an effective shielding up to high frequencies of the signals conducted via the right-angle connector.

The objects are achieved in each case by the features specified in the equivalent claims.

DISCLOSURE OF THE INVENTION

The right-angle connector according to the invention comprises a plurality of contact elements which are arranged next to one another and provided at the back of the right-angle connector for soldering to conductors of a printed circuit board, comprising an upper shielding arranged at least on the upper side of the right-angle connector and a lower shielding arranged on the lower side is characterised in that the lower shielding contains a lower shielding element on the connector side, the shielding surface of said element being oriented in the connecting direction, the lower shielding furthermore contains a separate, rear lower shielding element, and the lower shielding elements are electrically connected to each other.

The right-angle connector according to the invention makes it possible to achieve a high-quality shielding. In particular, a homogeneous inductance layer is achieved inside the connector. The right-angle connector according to the invention is particularly suitable for conducting high-frequency signals. For example, a digital signal can be conducted with high quality at a data rate up to 10 Gigabit, a high signal integrity being ensured at the same time. The right-angle connector according to the invention is therefore especially suitable for signal-processing arrangements in which for example, printed circuit boards are to be connected to a backplane.

As a result of the at least two-part design of the lower shielding, the shielding of the right-angle connector according to the invention can be assembled particularly easily. At least the rear lower shielding element can be positioned at least partially in a connector housing before making the electrical connection during the assembly. Despite its high-quality design, the right-angle connector according to the invention can be manufactured cost-effectively. The right-angle connector according to the invention is therefore particularly suitable for cost-sensitive series production.

Advantageous further developments and embodiments of the right-angle connector according to the invention are obtained from dependent claims.

A first embodiment provides that the shielding surface of the rear lower shielding element is oriented perpendicular to the connecting direction. This embodiment is particularly suitable for a 90° right-angle connector.

Another embodiment provides that the shielding surface of the rear lower shielding element is oriented at least in sections parallel to the contact elements. With this measure, a high quality of the right-angle connector with respect to the homogeneous inductance profile inside the right-angle connector is achieved even for angles not equal to 90°.

One embodiment provides that the rear lower shielding element is guided at least approximately as far as the soldering connection of the contact elements. Therefore a complete shielding of the contact elements as far as the printed circuit board is achieved on the one hand. On the other hand, the printed circuit board can be fitted from above with the right-angle connector according to the invention.

A particularly advantageous embodiment provides that the lower shielding elements each have connecting surfaces which are welded together for the electrical connection of the lower shielding elements. A particularly easy assembly of the right-angle connector according to the invention is possible with this measure.

One embodiment provides the implementation of the connecting surfaces as flat connecting surfaces. It is preferably provided that the connector-side lower shielding element has a homogeneous connecting surface without recesses or cutouts, which extends over a plurality of contact elements, preferably over all the contact elements. This measure also helps the achieve the completest possible shielding of the contact elements.

As already mentioned, at least one lower shielding element can be disposed at least partially inside a connector housing. One embodiment provides that the rear lower shielding element is disposed at least in the area of the connection to the connector-side lower shielding element inside the connector housing.

A further development of this element provides that the rear lower shielding element has a plurality of separately formed connecting surfaces and that the connector housing has separate recesses corresponding to said connecting surfaces for guiding and at least partially accommodating the rear lower shielding element.

Another embodiment provides that the upper shielding contains a connector-side upper and rear upper shielding element which are electrically connected to one another. The at least two-part configuration enables a simple realisation of the shielding, where for example the connector-side upper shielding element can be disposed at least partially inside the connector housing.

An advantageous further development of this embodiment provides that the upper shielding elements have connecting surfaces which are welded together for the electrical connection of said upper shielding elements. As a result, both the lower and the upper shielding elements can be processed with the same technology.

A further embodiment provides that at least one connector-side shielding element has an expansion offset and that the upper and/or lower connector-side shielding element has spring tongues for clamping a corresponding shielding element of a corresponding right-angle connector. The at least one expansion offset allows one connector to dip into the corresponding connector. The spring tongues on the one hand improve the electrical contact between the two connectors and on the other hand provide a clamping force in the connected state of the connector The method according to the invention for producing the right-angle connector provides that the weld connection of at least the lower shielding elements is made by means of laser welding. Laser welding offers the possibility of making electrical contact between the lower shielding elements even in barely accessible places inside the connector housing. If the connecting surfaces of the lower shieldings lie inside the connector housing, the laser beam can be guided up to the connection point through an opening provided in the connector housing.

According to one embodiment of the method according to the invention, the use of an in particular pulsed neodymium YAG laser is provided.

An advantageous embodiment of the right-angle connector according to the invention which is provided in particular in conjunction with the method of manufacture according to the invention by means of laser welding provides at least one opening in at least one connecting surface of the lower and/or upper rear shielding element, which is preferably designed as a hole. The openings enable a precise focusing of the laser beam. In particular, optimal welding with a minimal amount of heat is achieved whereby not only the welded shielding elements but in particular the connector housing made of plastic are protected during the welding.

Other advantageous further developments and embodiments of the right-angle connector according to the invention and the method are obtained from the following description. Exemplary embodiments of the invention are shown in the drawings and described in detail in the following description.

Figure 2:
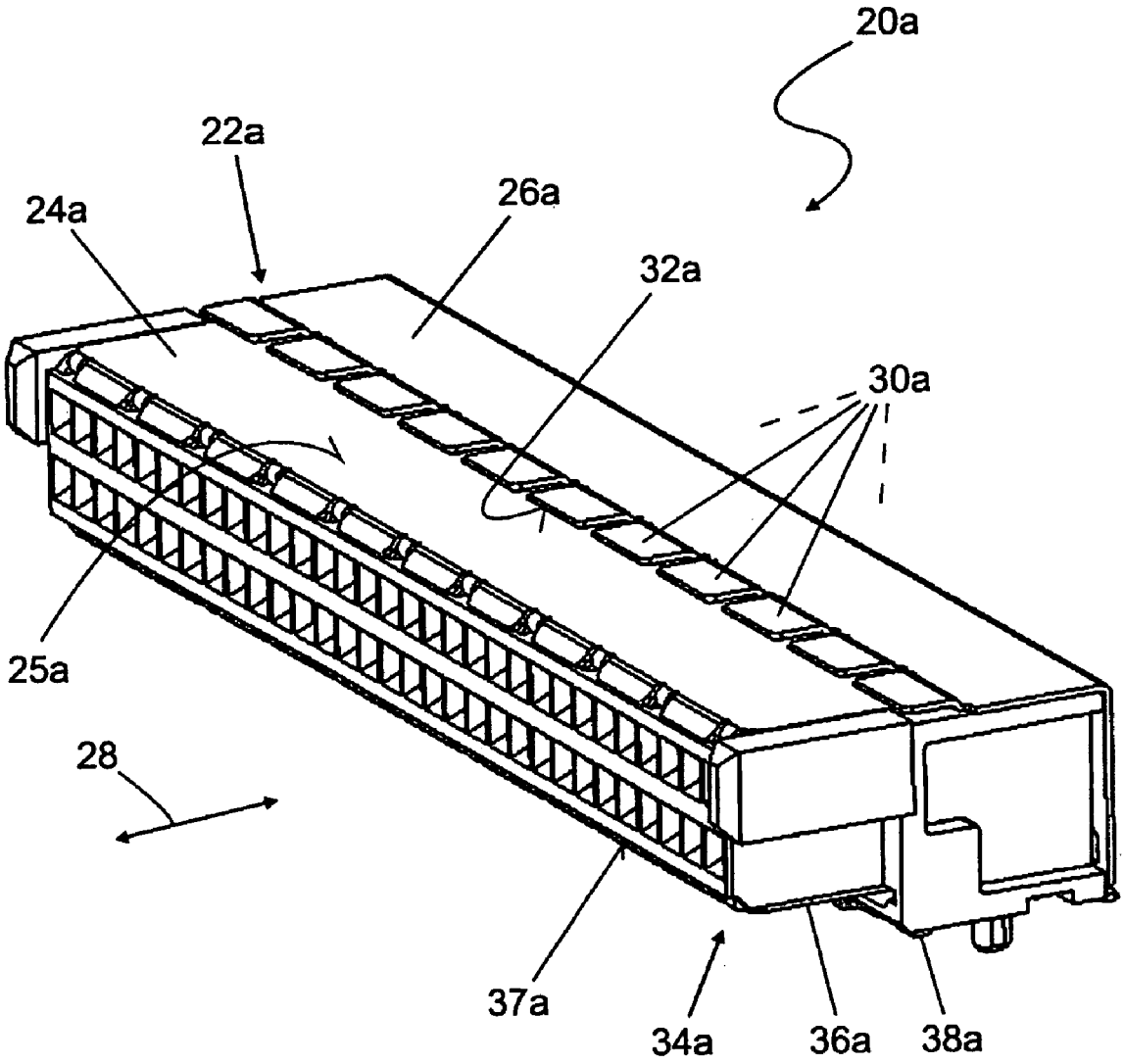
Figure 3:
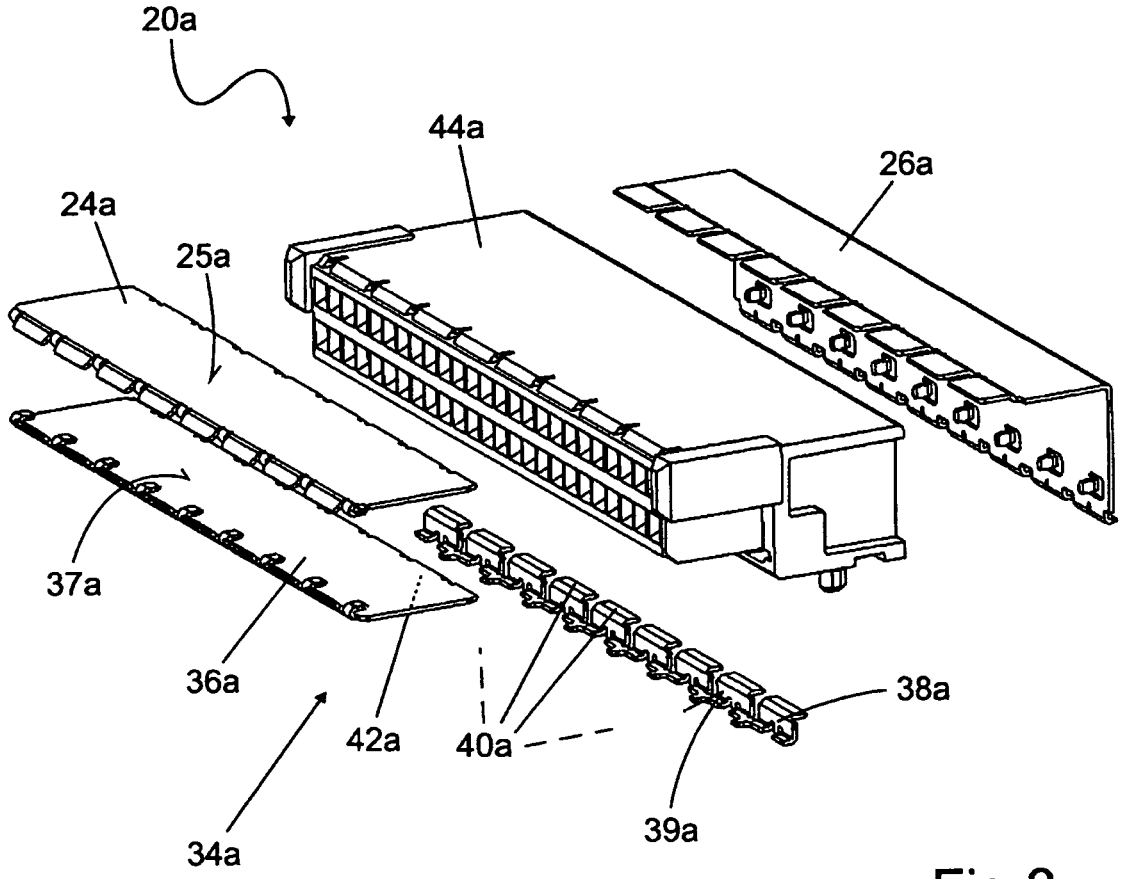
Figure 4:
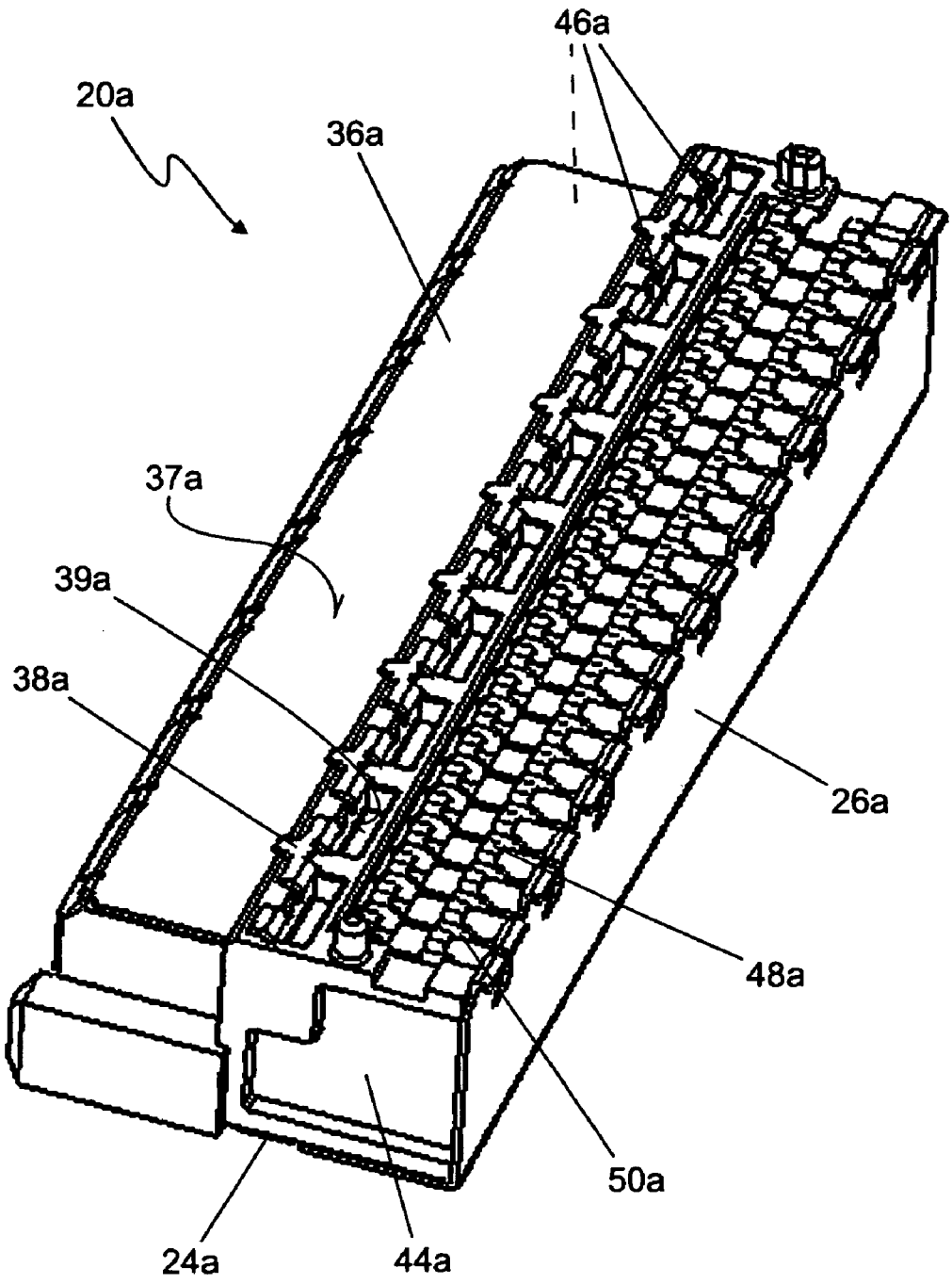
Figure 5:
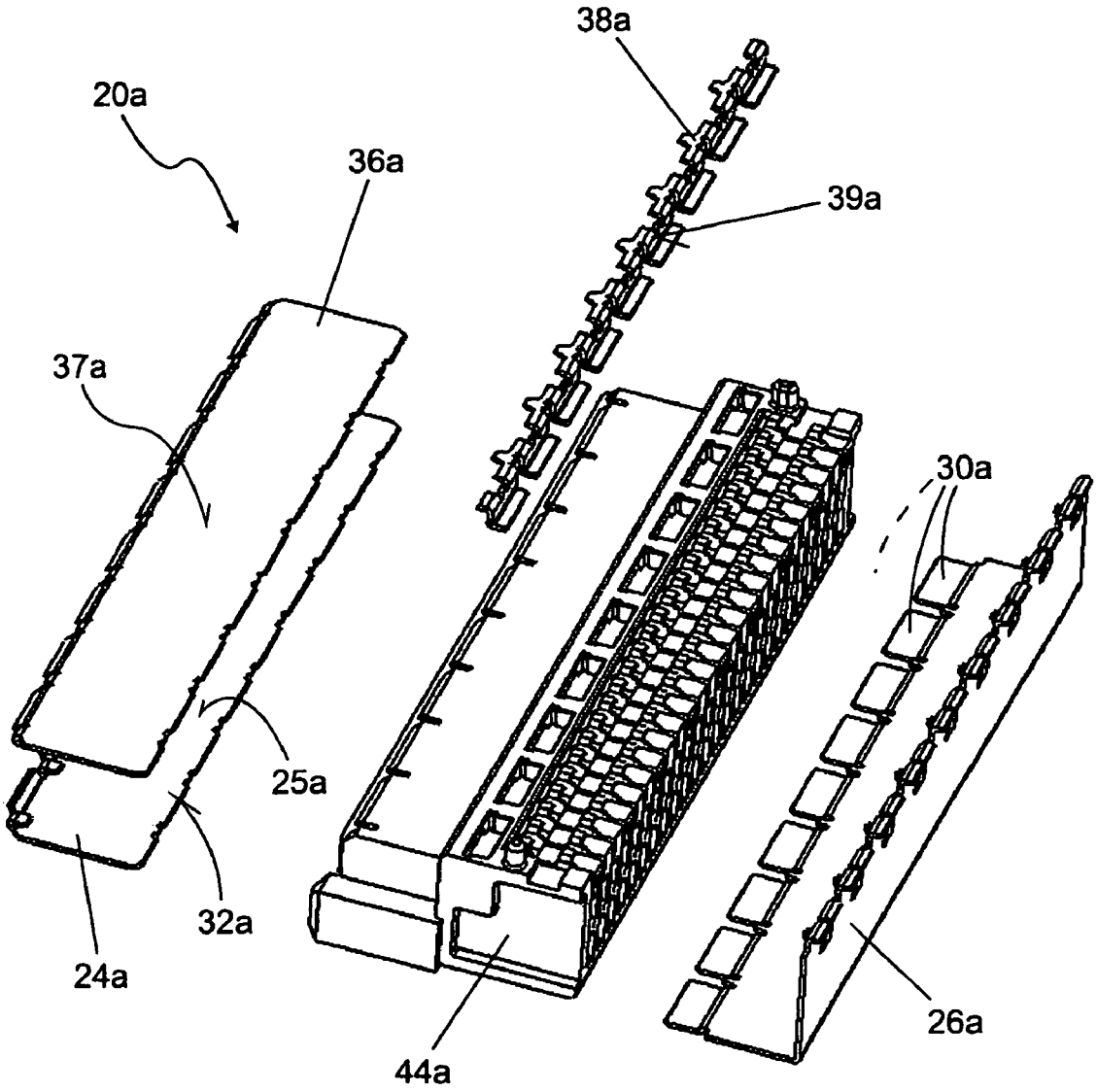
Figure 6:
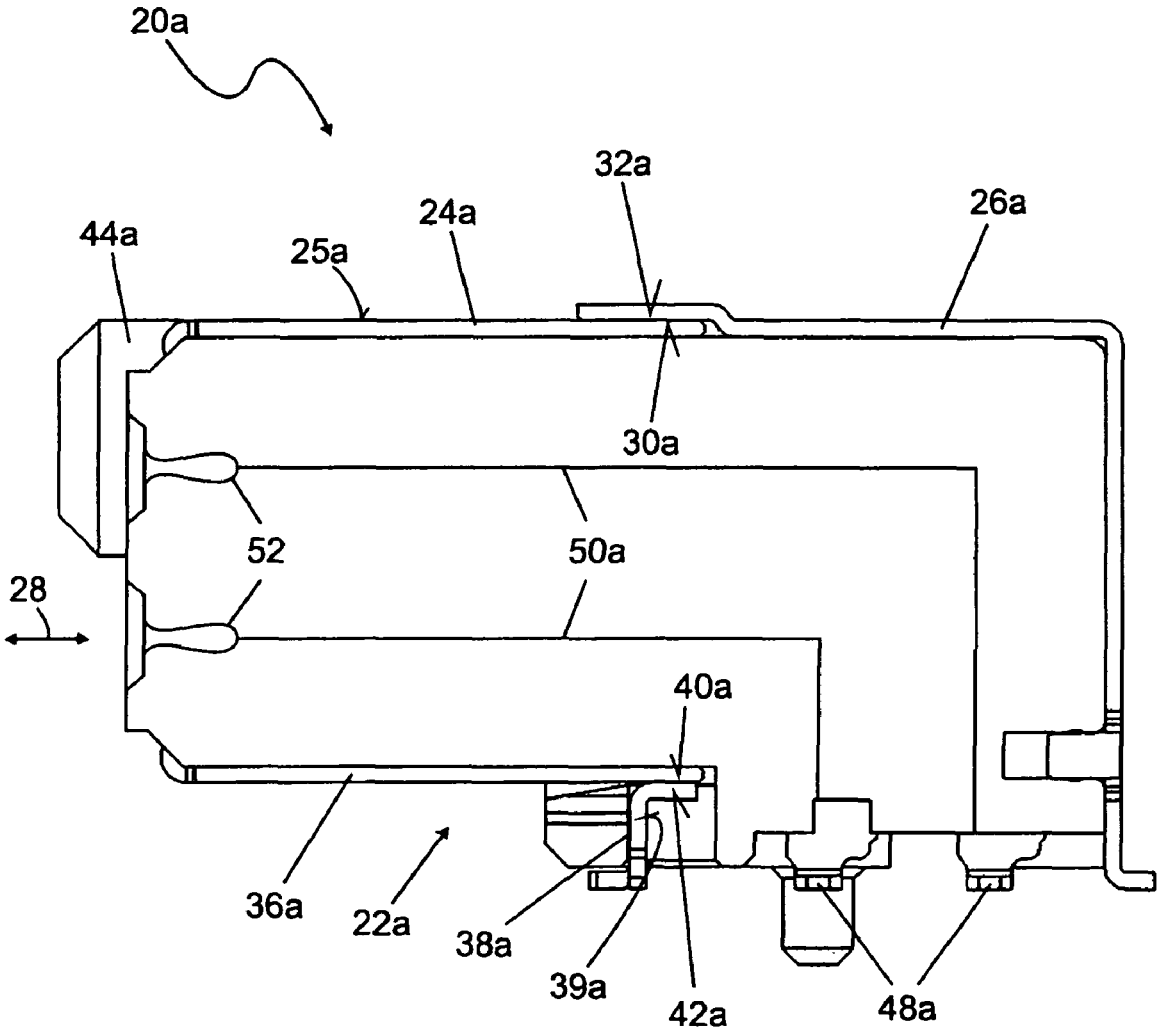
Figure 7:
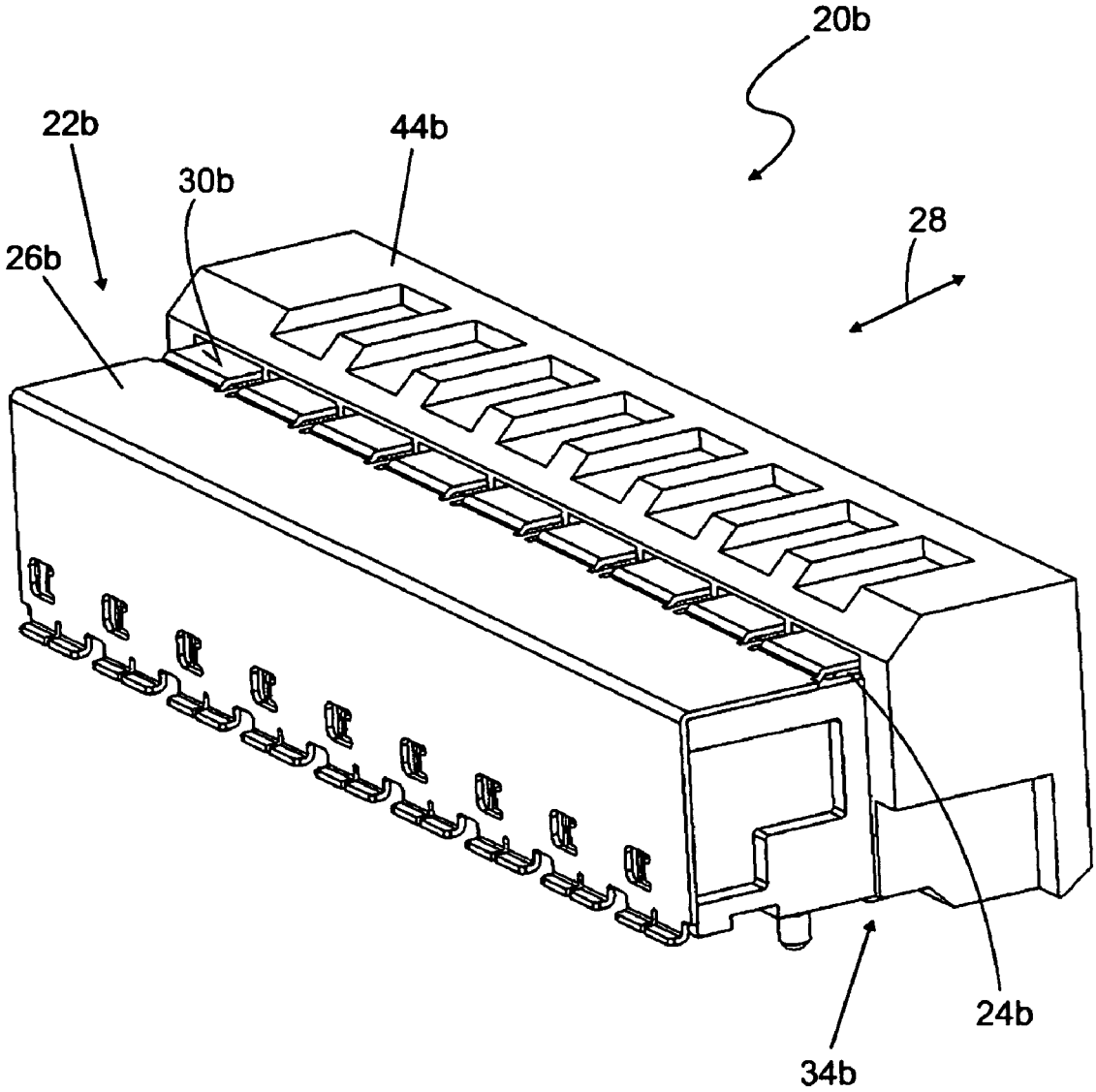
Figure 8:
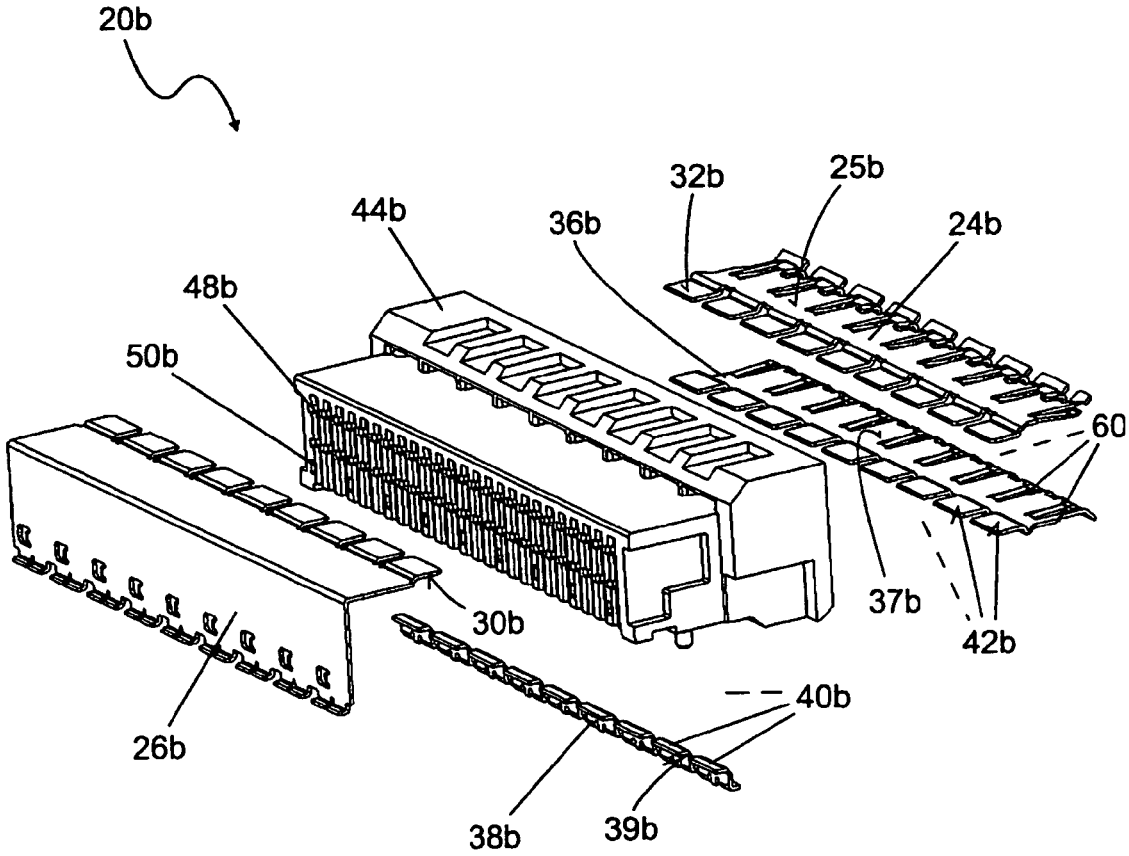
Figure 9:
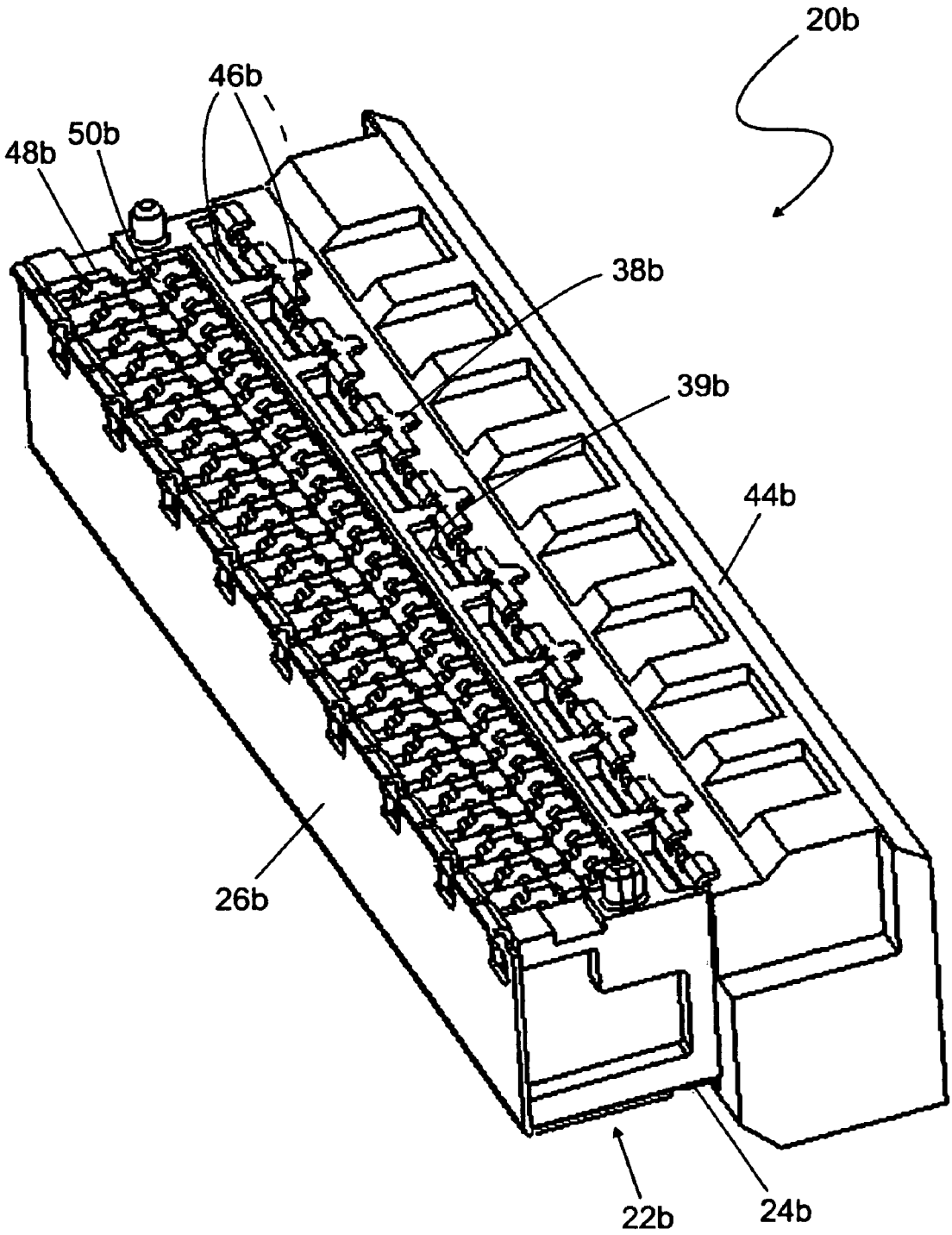
Figure 10:
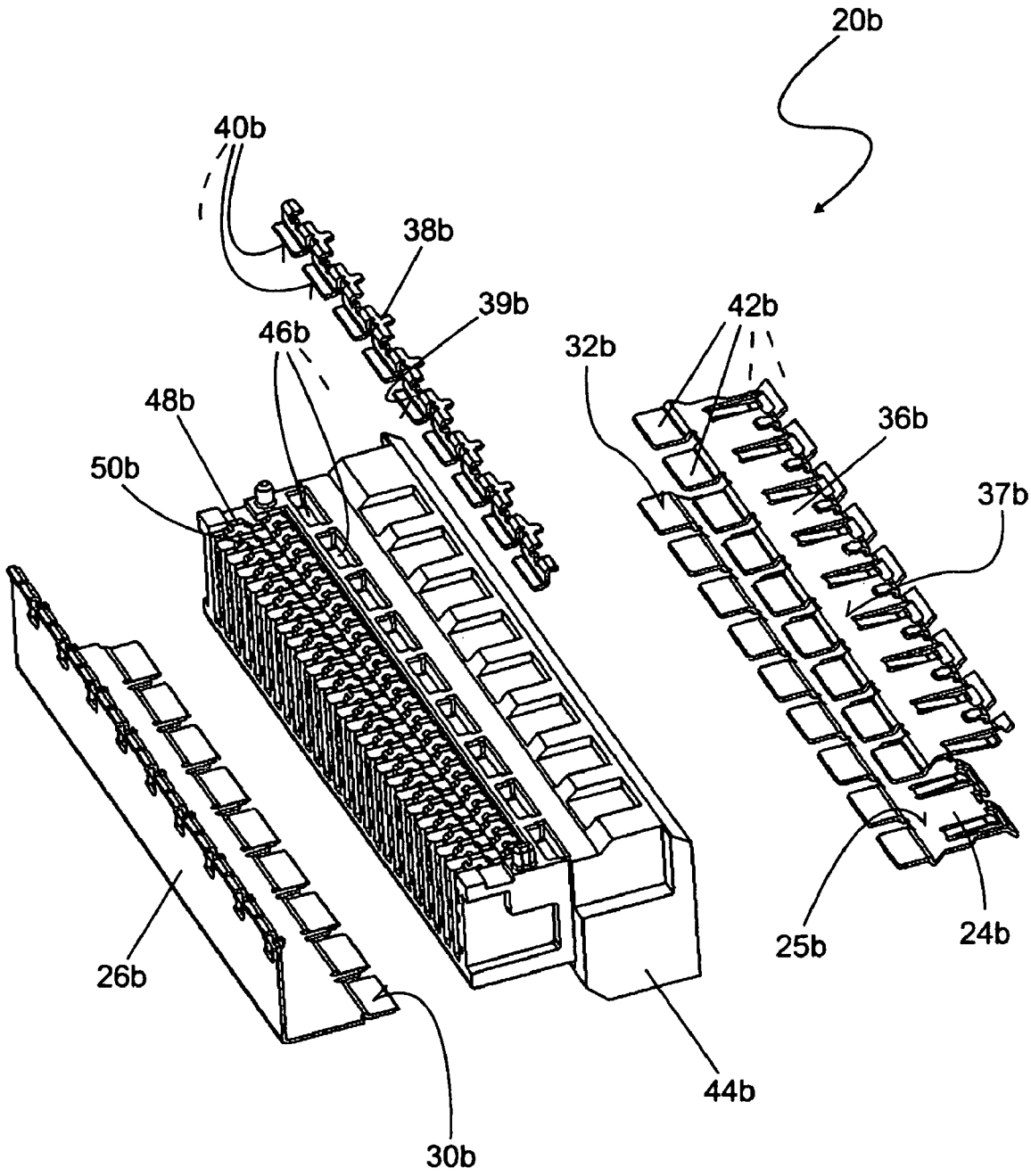
Figure 11:
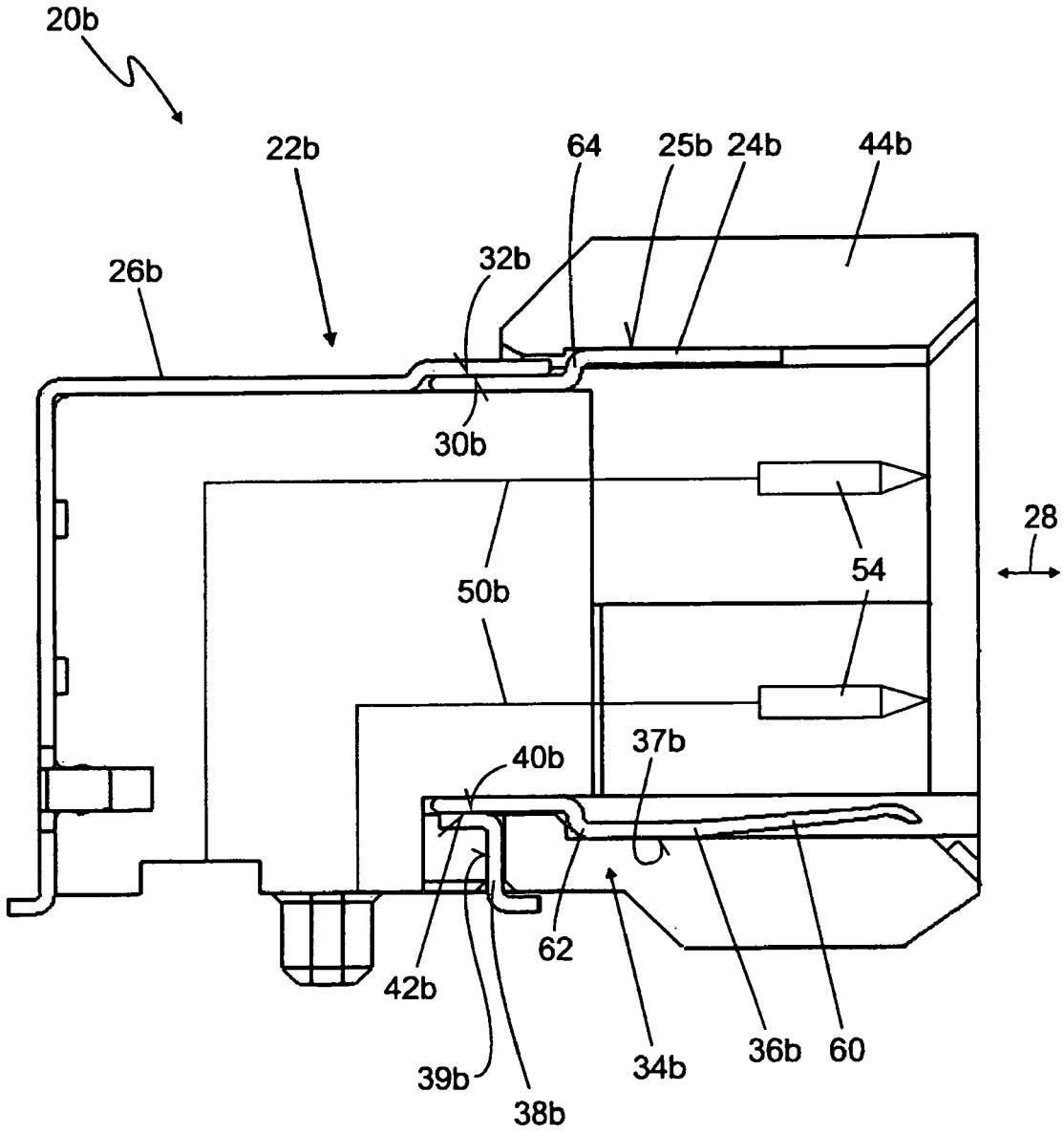
Figure 12:
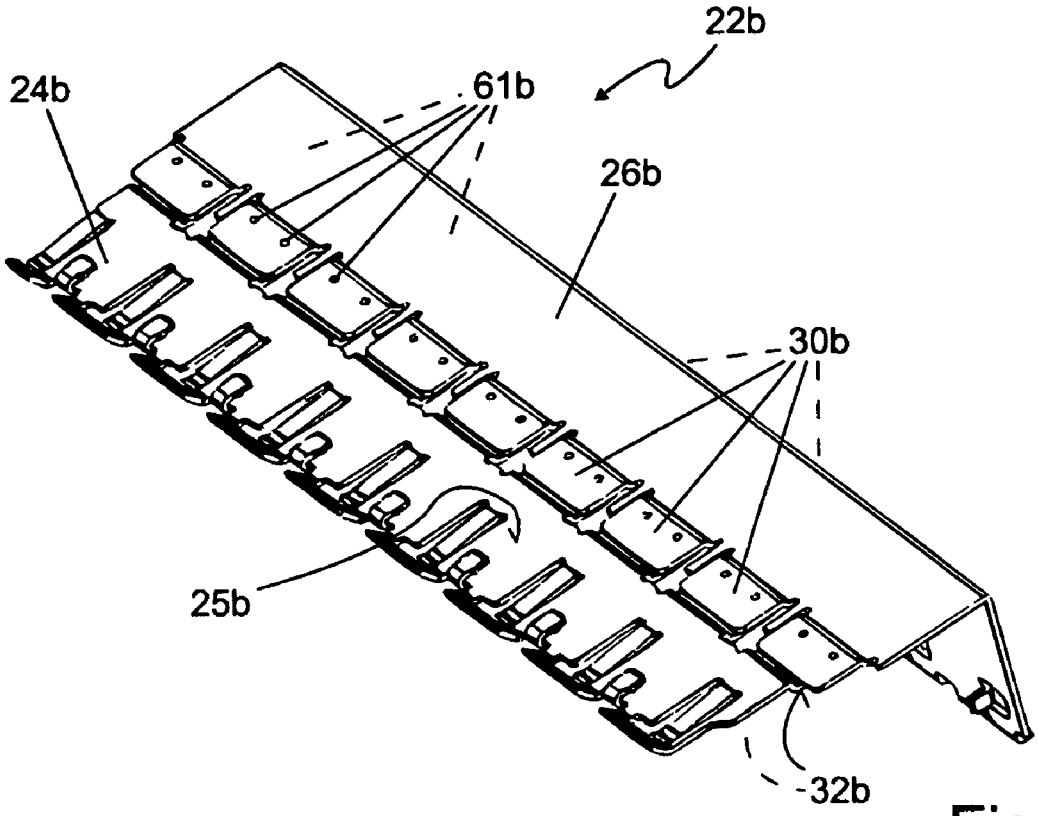
Figure 13:
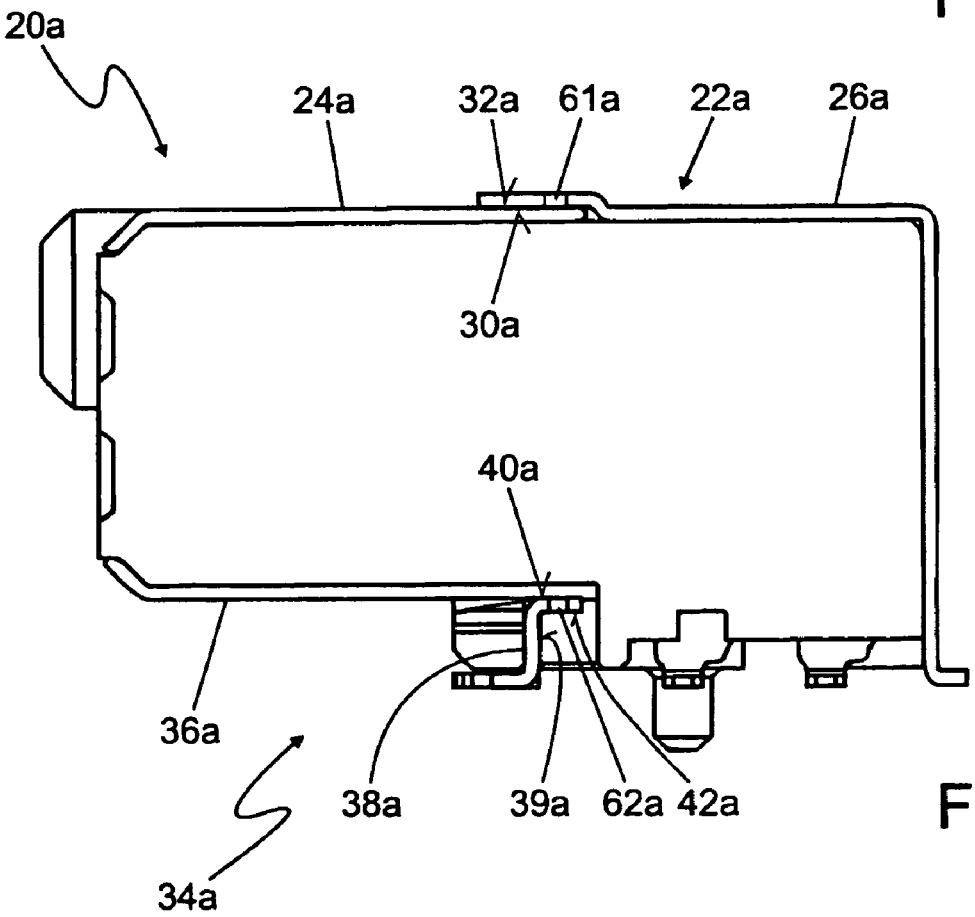
Figure 14:
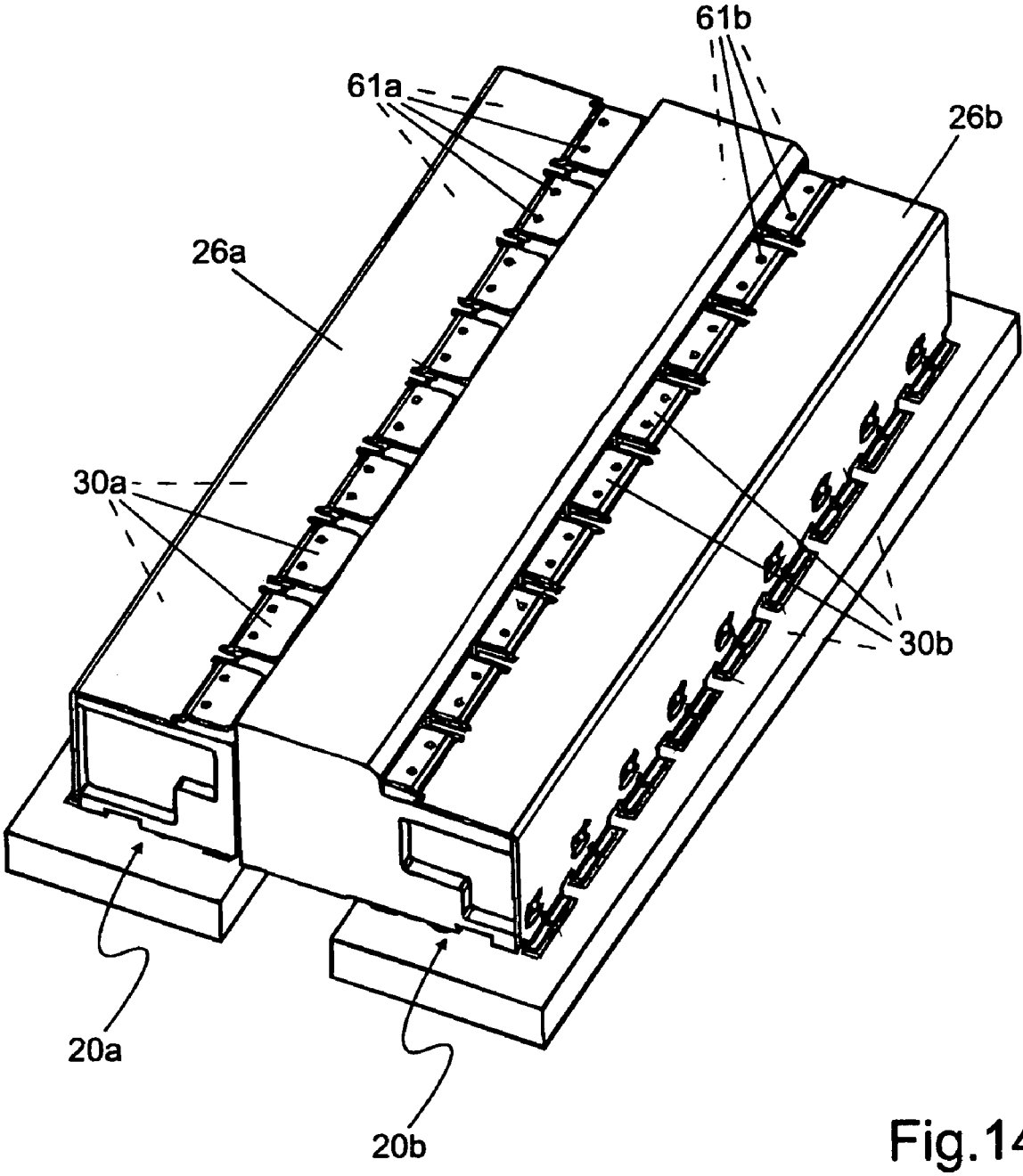

In the figures:

FIG. 1 shows a sectional view through a right-angle connector known from the prior art, FIG. 2 shows a first view of the front and upper side of a right-angle connector according to the invention, FIG. 3 shown an exploded view of the right-angle connector shown in FIG. 2, FIG. 4 shows a second view of the lower and rear side of the right-angle connector, FIG. 5 shows an exploded view of the right-angle connector shown in FIG. 4, FIG. 6 shows a simplified sectional view through the right-angle connector, FIG. 7 shows a first view of the rear and upper side of a corresponding right-angle connector, FIG. 8 shows an exploded view of the corresponding right-angle connector shown in FIG. 7, FIG. 9 shows a second view of the rear and lower side of the corresponding right-angle connector, FIG. 10 shows an exploded view of the corresponding right-angle connector shown in FIG. 9, FIG. 11 shows a simplified sectional view through the corresponding right-angle connector shown in FIG. 7, FIG. 12 shows an isometric view of shielding elements of the corresponding right-angle connector shown in FIG. 7 which shows a special configuration of connecting surfaces, FIG. 13 shows a simplified sectional view through the right-angle connector corresponding to FIG. 6 which shows a corresponding configuration of connecting surfaces shown in FIG. 12 and FIG. 14 shows an isometric view of a right-angle connector in the connected state with a corresponding right-angle connector.

FIG. 1 shows a sectional view through a right-angle connector 1 described in the catalogue E 074482 of the applicant specified initially, in which a plurality of superposed contact elements 2 is provided, these being provided on the rear lower side 3 of the right-angle connector 1 for soldering to conductors of a printed circuit board 4 which are not visible.

The contact elements 2 are accommodated in an insulating connector housing 5 that is shielded by a shielding 6, 7 which is shown simplified. The shielding is composed of an upper shielding 6 and a lower shielding 7. In the front connector-side region, recesses are cut out from the shielding 6, 7 both on the upper side and on the underside and the remaining bridges are curved outwards to form spring tongues 8, 9 which enable a reliable contacting and clamping of the shielding of a corresponding connector. The lower shielding 7 encloses the underside of the end pieces 10 of the contact elements 2 provided for soldering to the conductors of the printed circuit board 4, not shown, and in the mounted state of the right-angle connector 1 covers the entire contacting region on the underside of the printed circuit board 4.

FIG. 2 shows a right-angle connector 20*a* according to the invention which contains a plurality of adjacently disposed non-visible contact elements where in the exemplary embodiment shown, two superposed rows of contact elements are further provided. The right-angle connector 20*a* according to the invention contains an upper shielding 22*a* which in the exemplary embodiment shown is composed of a connector-side upper shielding element 24*a* with a shielding surface 25*a* and a rear upper shielding element 26*a*.

In the exemplary embodiment shown, the transition between the upper shielding elements 24*a*, 26*a* lies approximately at the centre of the surface relative to the connecting direction 28.

According to one exemplary embodiment, it is provided that the rear upper shielding element 26*a* in connecting direction 28 has separately formed connecting surfaces 30*a* which make the electrical connection to the connector-side upper shielding element 24*a* in the mounted state of the right-angle connector 20*a*. Optionally, separately formed connecting surfaces 32*a* can also be provided on the connector-side upper shielding element 24*a*, which correspond to the connecting surfaces 30*a* of the rear upper shielding element 26*a*.

The right-angle connector 20*a* according to the invention further contains a lower shielding 34*a* which is composed of a connector-side lower shielding element 36*a* with a shielding surface 37*a* and a rear lower shielding element 38*a*, the shielding surface 37*a* of the connector-side lower shielding element 36*a* being oriented at least approximately in connecting direction 28.

The lower shielding 34*a* can only be seen in outline in the view of the front and upper side of the right-angle connector 20*a* according to the invention shown in FIG. 2. For illustration an exploded view of the right-angle connector 20*a* shown in FIG. 2 is therefore shown in FIG. 3. Those parts shown in FIG. 3 which agree with the parts shown if FIG. 2 are each designated with the same reference numbers. This agreement also applies to the following figures.

FIG. 3 illustrates in particular the two-part configuration of the lower shielding 34*a* with the connector-side lower shielding element 36*a* and the rear lower shielding element 38*a*.

FIG. 3 shows an advantageous embodiment of the rear lower shielding element 38*a* with a shielding surface 39*a* which has separately formed connecting surfaces 40*a* which are provided to make the electrical connection with the connector-side lower shielding element 36*a*. For this purpose, the connector-side lower shielding element 36*a* has at least one corresponding connecting surface 42*a* wherein in the exemplary embodiment shown a homogeneous surface without cutouts or recesses is provided, extending over the entire rear end of the connector lower shielding element 36*a*. According to one embodiment it can be provided that the connector-side lower shielding element 36*a* also has separately formed connecting surfaces corresponding to the separately formed connecting surfaces 40*a* of the rear lower shielding element 38*a*.

FIG. 3 gives a complete view of the connector housing 44*a* in which the non-visible contact elements are accommodated.

The two-part configuration of the lower shielding 34*a* enables both the connector-side lower shielding element 36*a* and also in particular the rear lower shielding element 38*a* to be arranged at least partially inside the connector housing 44*a*, where the electrical connection between the two lower shielding elements 36*a*, 38*a* can only be made after insertion into the connector housing 44*a*.

FIG. 4 shows a second view of the lower and rear side of the right-angle connector 20*a* according to the invention. FIG. 4 shows in particular the positioning of the connecting surfaces 40*a* of the rear lower shielding element 38*a* which in the mounted state of the rear lower shielding element 38*a* are positioned in recesses 46*a* of the connector housing 44*a*. The second view shown in FIG. 4 gives a view of the solder connections 48*a* of the contact elements 50*a* accommodated in the connector housing 44*a*.

To illustrate the assembly in particular of the rear lower shielding element 38*a*, FIG. 5 shows an exploded view of the right-angle connector 20*a* shown in FIG. 4. FIG. 5 illustrates in particular the arrangement of the recesses 46*a* in the connector housing 44*a*.

The right-angle connector 20*a* according to the invention in particular makes it possible to achieve a high-quality shielding 22*a*, 34*a*. In particular a homogeneous inductance layer is achieved inside the right-angle connector 20*a*. As a result, the right-angle connector 20*a* according to the invention is particularly suitable for conducting high-frequency signals. The right-angle connector 20*a* according to the invention is particularly suitable for connections between signal processing arrangements where digital signals can be conducted via the connection at data rates up to 10 Gigabits with high signal integrity. The frequency-dependent signal damping only occurs at very high frequencies. In particular a position-dependent constant wave impedance can be achieved inside the right-angle connector 20*a* according to the invention as a result of the high quality shielding 22*a*, 34*a* due in particular to the two-part configuration of the lower shielding 34*a* which particularly contributes to minimising position-dependent signal reflections and signal falsifications caused thereby.

Furthermore, as a result of the two-part design of the lower shielding 34*a*, easy assembly of the lower shielding 34*a* is possible, particularly when the connector-side lower shielding element 36*a* and in particular the rear lower shielding element 38*a* are disposed at least partially inside the connector housing 44*a*.

According to an advantageous embodiment forming the basis of FIGS. 2-5, it is provided that the shielding surface 39*a* of the rear lower shielding element 38*a* is oriented at least approximately perpendicular to the connecting direction 28. This embodiment is therefore particularly suitable for a 90° right-angle connector 20*a*.

Another embodiment provides that the shielding surface 39*a* of the rear lower shielding element 38*a* is oriented parallel to the contact elements 50*a* at least in sections. As a result, a high quality of the right-angle connector 20*a* with regard to the homogeneous inductance profile inside the right-angle connector 20*a* is even achieved at angles not equal to 90° provided that an angle of not equal to 90° is provided.

In the exemplary embodiment of the right-angle connector 20*a* according to the invention shown, it is assumed that the rear lower shielding element 38*a* is guided at least approximately as far as the solder connection 48*a* of the contact elements 50*a*. As a result, a complete shielding of the contact elements 50*a* is achieved as far as the printed circuit board not shown in detail. Furthermore, as a result of this embodiment the printed circuit board with the right-angle connector 20*a* according to the invention can be fitted from above.

A quite particularly advantageous embodiment provides that the connecting surface 40*a* of the rear lower shielding element 38*a* or the connecting surface 42*a* of the connector-side lower shielding element 36*a* are welded together to make the electrical connection of the shielding elements 36*a*, 38*a*.

Such a welded connection can advantageously be provided for welding the upper shielding elements 24*a*, 26*a* provided that the upper shielding 22*a* is configured to be multi-part. In this case, the welded connection will be made between the optionally provided connecting surfaces 30*a* of the rear upper shielding element 26*a* with the corresponding connecting surface 32*a* of the connector-side upper shielding element 24*a*.

The method according to the invention for producing the right-angle connector 20*a* according to the invention provides for making the welded connection of the lower shielding elements 36*a*, 38*a* and optionally the upper shielding elements 24*a*, 26*a* by means of laser welding. Laser welding in particular makes it possible to make the welded connection if, during assembly, the lower shielding elements 36*a*, 38*a* are already located inside the connector housing 44*a* to make the electrical connection.

In this case the welding can be carried out through the recesses 46*a* in the connector housing 44*a*.

If there is a visible connection from the front side of the right-angle connector 20*a* in connecting direction 28 onto the upper side of the connecting surface 42*a* of the connector-side lower shielding element 36*a*, the welding of the shielding elements 36*a*, 38*a* of the lower shielding 34*a* can be made through the contact chambers from the front side of the right-angle connector 20*a*. In particular a neodymium YAG laser is provided for producing the welding. Such a laser has the advantage of a good energy meterability. Pulsed operation with pulse durations which can extend down into the femto-second range is particularly advantageous. This laser is also suitable for the surface treatment of the shielding elements 24*a*, 26*a*, 36*a*, 38*a*.

The simplified sectional view shown in FIG. 6 through the right-angle connector 20*a* according to the invention illustrates the positioning in particular of the two shielding elements 36*a*, 38*a* of the lower shielding 34*a*.

The at least one connecting surface 40*a* of the rear lower shielding element 38*a* abuts against the corresponding connecting surface 42*a* of the connector-side lower shielding element 36*a*. The two connecting surfaces 40*a*, 42*a* can be curved corresponding to one another. In the exemplary embodiment shown, a flat surface is assumed. The specific configuration of the connecting surfaces 40*a*, 42*a* can be specified depending on the predefined distance from the contact elements 50*a* which is shown in simplified form in FIG. 6. In order to achieve a homogeneous position-dependent induction profile inside the right-angle connector 20*a* according to the invention, the lower shielding elements 36*a*, 38*a* are preferably guided parallel to at least one contact element 50*a*, at least in sections.

FIG. 6 furthermore illustrates the electrical connection between the upper shielding elements 24*a*, 26*a* if the upper shielding 22*a* is configured to be multi-part. The connecting surfaces 30*a* of the rear upper shielding element 26*a* are preferably welded together with the at least one shielding surface 25*a* of the connector-side upper shielding element 24*a*. Naturally, the method according to the invention for laser welding can also be used at this position.

In the exemplary embodiment shown according to FIG. 6, the contact elements 50*a* have contact springs 52 on the connector-side front end.

FIGS. 7-11 shows a corresponding right-angle connector 20*b* according to the invention which has components the same as the right-angle connectors 20*a* according to the invention, shown initially, the corresponding components being provided with the index "b" instead of the index "a" in the reference numbers.

The right-angle connector 20*b* according to the invention according to FIG. 7 also has a connector housing 44*b* which is surrounded by an upper shielding 22*b* and by a lower shielding 34*b*. The upper shielding 22*b* contains a connector-side front shielding element 24*b* and a rear upper shielding element 26*b*, where the rear upper shielding element 26*b* should have separately formed connecting surfaces 30*b* for electrical contact to the connector-side upper shielding element 24*b*.

To illustrate the individual components of the right-angle connector 20*b* according to the invention, FIG. 8 shows an exploded view of the right-angle connector 20*b* reproduced in FIG. 7. In contrast to the configuration in the first right-angle connector 20*a* according to the invention, in the corresponding right-angle connector 20*b*, instead of a homogeneous connecting surface 42*a*, separately formed connecting surfaces 42*b* are provided on the connector-side front shielding element 36*b* which correspond to the separately formed connecting surfaces 40*b* of the rear lower shielding element 38*b*. Furthermore, recesses from which spring tongues 60 are bent out are provided at the connector-side end of the connector-side upper shielding element 24*b*.

FIG. 9 shows a view of the rear and lower side of the corresponding right-angle connector 20*b* in the mounted state. In the corresponding right-angle connector 20*b*, the connecting surfaces 40*b* of the rear lower shielding element 38*b* are also positioned in recesses 46*b* of the connector housing 44*b*.

To illustrate the individual components, FIG. 10 again shows an exploded view of the corresponding right-angle connector 20*b* reproduced in FIG. 9.

The simplified sectional view shown in FIG. 11 through the corresponding right-angle connector 20*b* according to the invention again illustrates the positioning in particular of the two shielding elements 36*b*, 38*b* of the lower shielding 34*b*.

Instead of the contact springs 52, the corresponding plug connector 20*b* has contact blades 54.

The electrical connection of the connecting surfaces 40*b*, 42*b* of the lower shielding 34*b* and optionally the connecting surfaces 30*b*, 32*b* of the upper shielding 22*b* are again advantageously made using the laser welding method according to the invention.

The plane of intersection forming the basis of FIG. 11 is selected in such a manner that one of the spring tongues 60 of the connector-side lower shielding element 36*b* can be seen. Furthermore, FIG. 11 shows an embodiment of the connector-side upper shielding element 24*b* and/or the connector-side lower shielding element 36*a*, 36*b* according to which at least one lower shielding element 24*b* has an offset 62, 64 which makes it possible to accommodate the initially described right-angle connector 20*a* according to the invention.

FIG. 12 shows an isometric view of an advantageous embodiment of the rear shielding elements 26*a*, 26*b*, 38*a*, 38*b*, where in the exemplary embodiment shown in FIG. 12 as an example, the upper shielding 22*b* of the corresponding right-angle connector 20*b* shown in FIGS. 7-11 is depicted.

The embodiment relates to recesses 61*b* provided in the connecting surfaces 30*b* of the rear upper shielding element 26*b*. In the exemplary embodiment shown two recesses 61*b* are provided as an example in each connecting surface 30*b*. The recesses 61*b* are preferably designed as holes so that a simple and inexpensive implementation is possible.

The recesses 61*b* allow a precise focussing when laser welding. As a result, an optimal welding of the rear upper shielding element 26*a* with the front upper shielding element 24*b* is achieved, where only a minimal amount of heat needs to be supplied. As a result, not only the shielding elements 26*b*, 24*b* to be welded together but in particular the connector housing 44*b* shown in FIG. 12 are subjected to very little thermal loading.

Advantageously such recesses 61*b* are also provided in the connecting surfaces 40*b* of the rear lower shielding element 38*b* shown in FIG. 8.

A corresponding opening in the rear lower shielding element 38*a*, 38*b* is shown as an example in FIG. 13 for the example of the right-angle connector 20*a*, where FIG. 13 at least partially corresponds to the sectional view shown in FIG. 6. FIG. 13 shows an opening 61*a* cut in the rear upper shielding element 26*a* of the upper shielding 22*a* of the right-angle connector 20*a*. FIG. 6 further shows a cut opening 62*a* provided in the connecting surface 40*a* of the rear lower shielding element 38*a*.

Corresponding openings, not shown in detail, can advantageously also be provided in the connecting surfaces 40*b* of the rear lower shielding element 28*b* of the corresponding right-angle connector 20*b*.

FIG. 13 illustrates that the laser beam produced during the laser welding passes through the openings 61*a*, 61*b*, 62*a*, and the corresponding openings in connecting surfaces 40*b* of the rear lower shielding element 28*b*, impinges upon the connecting surfaces 32*a*, 32*b*, 42*a*, 42*b* of the front shielding elements 24*a*, 24*b*, 36*a*, 36*b* and can perform the welding.

FIG. 14 shows an isometric view of a right-angle connector 20*a* according to the invention in the connected state with a corresponding right-angle connector 20*b* according to the invention. In the exemplary embodiment shown, openings 61*a* are provided in the connecting surfaces 30*a* of the rear upper shielding element 26*a* of the right-angle connector 20*a* and openings 61*b* are provided in each of the connecting surfaces 30*b* of the rear upper shielding element 26*b* of the corresponding right-angle connector 20*b*. Preferably the openings 62*a*, and the corresponding openings in connection surfaces 40*b* of the rear lower shielding element 28*b* described are also provided in each of the connecting surfaces 40*a*, 40*b* of the rear lower shielding element 38*a*, 38*b* not visible in FIG. 14.

Not only the openings 61*b* in the connecting surfaces 30*b* of the rear upper shielding element 26*b* shown as an example in FIG. 12 but all the openings 61*a*, 61*b*, 62*a*, and the corresponding openings in the connecting surfaces 40*b* of the rear upper and lower shielding elements 26*a*, 26*b*, 38*a*, 38*b* are expediently designed as holes with a view to the particularly simple and therefore cost-effective implementation. The hole diameter can, for example, be 0.2 mm.

The invention claimed is:

1. A right-angle connector comprising a plurality of contact elements which are arranged next to one another and provided at the back of the right-angle connector for soldering to conductors of a printed circuit board, comprising an upper shielding arranged at least on the upper side of the right-angle connector and a lower shielding arranged on the lower side;

wherein the lower shielding contains a lower shielding element on the connector side, the shielding surface of said element being oriented in the connecting direction, the lower shielding furthermore contains a separate, rear lower shielding element, and the lower shielding elements are electrically connected to each other; and wherein the lower shielding elements have connecting surfaces which are welded together for the electrical connection of the lower shielding elements.

2. The right-angle connector according to claim 1, wherein the shielding surface of the rear lower shielding element is oriented perpendicular to the connecting direction.

3. The right-angle connector according to claim 1, wherein the shielding surface of the rear lower shielding element is oriented at least in sections parallel to the contact elements.

4. The right-angle connector according to claim 1, wherein the rear lower shielding element extends at least approximately as far as a soldering connection of the contact elements.

5. The right-angle connector according to claim 1, wherein the connecting surfaces are flat connecting surfaces.

6. The right-angle connector according to claim 1, wherein at least one opening is provided in at least one connecting surface of the rear lower shielding element.

7. The right-angle connector according to claim 6, wherein the opening is designed as a hole.

8. The right-angle connector according to claim 1, wherein the upper shielding contains a connector-side upper and rear upper shielding element which are electrically connected to one another.

9. The right-angle connector according to claim 1, wherein at least one connector-side shielding element has an expansion offset and wherein the upper and/or lower connector-side shielding element has spring tongues for clamping a corresponding shielding element of a corresponding right-angle connector.

10. A right-angle connector comprising a plurality of contact elements which are arranged next to one another and provided at the back of the right-angle connector for soldering to conductors of a printed circuit board, comprising an upper shielding arranged at least on the upper side of the right-angle connector and a lower shielding arranged on the lower side;

wherein the lower shielding contains a lower shielding element on the connector side, the shielding surface of said element being oriented in the connecting direction, the lower shielding furthermore contains a separate, rear lower shielding element, and the lower shielding elements are electrically connected to each other; and wherein the lower shielding element on the connector side has a homogeneous connecting surface without recesses which extends over a plurality of contact elements.

11. A right-angle connector comprising a plurality of contact elements which are arranged next to one another and provided at the back of the right-angle connector for soldering to conductors of a printed circuit board, comprising an upper shielding arranged at least on the upper side of the right-angle connector and a lower shielding arranged on the lower side;

wherein the lower shielding contains a lower shielding element on the connector side, the shielding surface of said element being oriented in the connecting direction, the lower shielding furthermore contains a separate, rear lower shielding element, and the lower shielding elements are electrically connected to each other; and wherein the rear lower shielding element is disposed at least in the area of the connection to the connector-side lower shielding element inside a connector housing which at least partially accommodates the contact elements of the right-angle connector.

12. The right-angle connector according to claim 11, wherein the rear lower shielding element has a plurality of separately formed connecting surfaces and wherein the connector housing has separate recesses corresponding to said connecting surfaces for guiding and at least partially accommodating the rear lower shielding element.

13. The right-angle connector according to claim 12, wherein the upper shielding elements have connecting surfaces which are welded together for the electrical connection of said upper shielding elements.

14. The right-angle connector according to claim 13, wherein an opening is provided in at least one connecting surface of the rear upper shielding element.

15. A method for producing a right-angle connector, said right-angle connector comprising a plurality of contact elements which are arranged next to one another and provided at the back of the right-angle connector for soldering to conductors of a printed circuit board, comprising an upper shielding arranged at least on the upper side of the right-angle connector and a lower shielding arranged on the lower side;

wherein the lower shielding contains a lower shielding element on the connector side, the shielding surface of said element being oriented in the connecting direction, the lower shielding furthermore contains a separate, rear lower shielding element, and the lower shielding elements are electrically connected to each other; and wherein a welding connection of at least the lower shielding elements is made by laser welding.

16. The method according to claim 15, wherein a neodymium YAG laser is used for the laser welding.

17. The method according to claim 16, wherein the neodymium YAG laser is operated in pulsed mode.

* * * * *